United States Patent [19]

Perron

[11] 4,307,284

[45] Dec. 22, 1981

[54] ELECTRIC SPACE HEATER UNIT UTILIZING INCANDESCENT LAMPS AS THE HEAT SOURCE

[76] Inventor: Leo Perron, 362 Forbush Ave., Berlin, N.H. 03570

[21] Appl. No.: 117,083

[22] Filed: Jan. 31, 1980

[51] Int. Cl.[3] ..... H05B 1/00; F24H 3/00; F24H 9/02

[52] U.S. Cl. ..... 219/342; 219/347; 219/352; 219/354; 219/358; 219/365; 219/552

[58] Field of Search ..... 219/342, 353–355, 219/377, 358, 365–370, 374, 375, 376, 552, 220, 347

[56] References Cited

U.S. PATENT DOCUMENTS

| | | | |
|---|---|---|---|
| 1,294,269 | 2/1919 | Hopkins | 219/552 |
| 1,652,438 | 12/1927 | Hicks | 219/377 |
| 1,713,013 | 5/1929 | Wandless | 219/377 |
| 1,926,473 | 9/1933 | Wood | 219/365 |
| 2,938,101 | 5/1960 | Borzner | 219/365 |

FOREIGN PATENT DOCUMENTS

| | | | |
|---|---|---|---|
| 135371 | 11/1949 | Australia | 219/375 |
| 2363006 | 7/1974 | Fed. Rep. of Germany | 219/365 |
| 504722 | 4/1939 | United Kingdom | 219/377 |
| 598741 | 2/1948 | United Kingdom | 219/377 |

*Primary Examiner*—A. Bartis

*Attorney, Agent, or Firm*—LeBlanc, Nolan, Shur & Nies

[57] ABSTRACT

An electric space heater unit includes a casing having front, rear and end walls providing an enclosure. An imperforate copper heat collector plate is disposed within the enclosure intermediate the top and bottom of the casing and extends the length and width of the interior casing space so as to divide the casing to a lower closed heating chamber and an upper heat distribution chamber. A plurality of conventional frosted 75 or 100 watt incandescent lamps are provided in the lower chamber in direct heat conductive contact with the undersurface of the plate. A heat radiation member in the form of a sinuous metal strip or a plurality of metal fins on a common metal support is disposed in the upper chamber in direct conductive contact with the upper surface of the plate. The top of the casing has an opening for passage of heat from the upper chamber into the space to be heated. The rear wall is contoured to reflect heat outwardly through the opening. The number of lamps energized can be varied to adjust the level of heat output.

8 Claims, 6 Drawing Figures

ELECTRIC SPACE HEATER UNIT UTILIZING INCANDESCENT LAMPS AS THE HEAT SOURCE

This invention relates to space heaters and is particularly concerned with space heater apparatus wherein heat derived from a plurality of electric lamps is distributed in a novel way.

The invention will be described in its preferred embodiment wherein a plurality of more or less conventional electric lamps, typically four of rated wattage, are mounted in an enclosing casing with their glass bulbs in contact with a plate of high heat conductivity, and an increased area radiation surface distributes heat from the plate.

The concept of deriving space heating from a plurality of electric lamps mounted within an enclosure has been proposed as evidenced by U.S. Pat Nos. to Sharpe 1,064,258; Muir et al. 2,051,456; Borgner 2,520,830; Covault et al. 2,919,338 and Borgner 2,938,101. However, Sharpe and Muir et al., disclose heat concentration by shaped reflectors, Borgner utilizes radiation from infra-red lamps and Covalt et al. discloses lamps associated with a relatively complete heat absorbtion and concentration structure.

The present invention distinguishes over such prior art by provision of novel structurally simple yet unexpectedly efficient heat transfer arrangements, and such is the major object of the invention.

It is a further object of the invention to provide an unusually efficient space heater wherein heat from a plurality of relatively low wattage electric lamps is efficiently utilized.

A more specific object of the invention is to provide a novel space heater, the interior of which is separated by a metal plate into a lower heating chamber and an upper heat distribution chamber wherein a plurality of electric lamps, which may, for example, be the usual conventional gas-filled 75 or 100 watt lamps conventionally used for illumination, are disposed in the lower chamber in direct heat transfer with the lower side of that metal plate, which is of copper or other metal of high heat conductivity, and an expanded area heat radiation means comprising a metal structure having convolutions or fins is secured in the upper chamber in direct heat transfer contact with the upper side of the metal plate, with heat from the upper chamber being passed into the space to be heated through a top opening in the casing.

PREFERRED EMBODIMENTS

Figure 1:
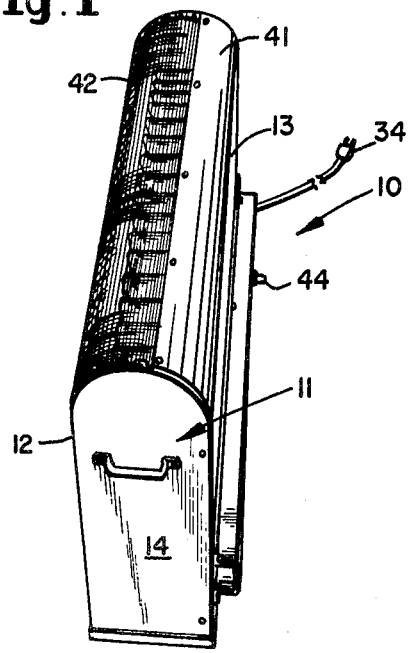
FIG. 1 is a generally perspective view taken from above and to one side showing a portable space heater according to a preferred embodiment of the invention.

The space heater 10 comprises a closed bottom enclosure 11 having parallel front and rear walls 12 and 13 fixed to shorter end walls 14 and 15. These walls are preferably of 24 gauge sheet metal. The enclosure 11 is mounted on four inturned corner legs 16 so as to be slightly spaced above a support surface such as a floor, thereby allowing free air movement into the enclosure space.

Near its upper end the space within the enclosure is bridged by an imperforate flat heat collector plate 17 that is generally horizontal. Plate 17 is of substantially the width and length of the space, thereby providing a closed bottom heat distribution chamber 18 above it within the enclosure. Plate 17 is preferably a sheet of thin copper, about 14 gauge, preferably slightly flexible, that is fixed to the inner sides of the enclosure end walls.

Below plate 17 the space is bridged longitudinally by a horizontal lamp mounting strip 19 on which are disposed four evenly spaced lamp sockets 21, 22, 23, and 24. These sockets may be the usual threaded type for accepting screw base lamps, and lamps 25≧28 are mounted therein.

In the invention the lamps 25–28 are adapted to burn upright, base down, which is their longest life position, and the glass bulbs engage snugly the smooth underside of plate 17 in heat transmitting contact. Since plate 17 is preferably longitudinally flexible it may give slightly to enable lamp replacement, and when the lamps are in position the slightly flexed condition of plate 17 ensures good area snug, heat transfer contact with all lamps. For ease in lamp replacement support 19 can be made adjustable by means of suitable screw and slot arrangements at its supported ends.

Figure 3:
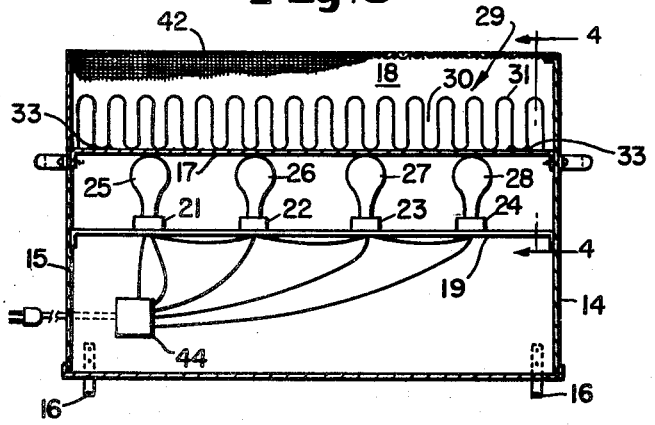
FIG. 3 is a section diagrammatically showing the arrangement of lamps, heat collector plate and radiation area in the heater of FIGS. 1 and 2.
Figure 4:
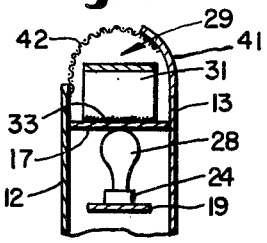
FIG. 4 is a fragmentary section substantially on line 4—4 in FIG. 3 showing detail of the heat transfer mode.

In the form shown in FIGS. 1 and 3 the increased area heat radiation surface is provided by a single sinuous strip 29 of highly heat conductive metal, such as 14 gauge copper. In practice in a working embodiment plate 17 is about six inches wide, the width of the space between the front and rear walls 12 and 13, and strip 29 may be above five inches wide bent into longitudinally spaced convulutions that extend up on loops 31 about six inches from the plate 17. The lower ends of each valley 30 between the loops are fixed in good heat conductive relation, as by soldered junctures indicated at 33 which permanently join strip 29 to plate 17. Where plate 17 is six inches wide and thirty inches long, the sinuous strip 29 prior to bending was about five inches wide and one hundred and forty inches long.

Figure 5:
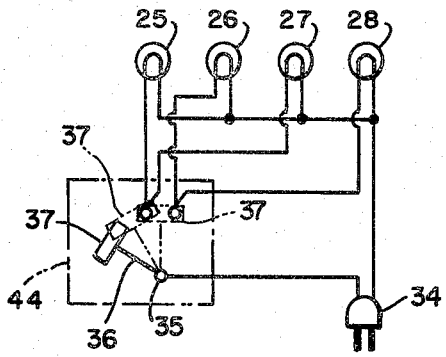
FIG. 5 is a schematic showing of a circuit for energizing two or four lamps for selective space heating.

In the preferred embodiment four lamps are used in the source of heat. The lamps are connected in circuit with a three position switch 44 whereby none, only two or all four may be energized as indicated in FIG. 5. As shown in FIG. 5 one wire from the usual plug 34 may be connected to switch terminal 35 which rockably mounts switch arm 36 shown in non-energizing position. Switch arm 36 may be relatively rocked to a low heat position wherein blade 37 acts to connect only two lamps 25 and 27 into the live circuit, or to connect all four lamps into the live circuit. Thus the heater as disclosed has two effective level heat outputs.

At the upper end of the casing as shown the rear wall may be curved for about 90° to provide a top wall section 41 that may act partly as a heat reflector, and the front of the top wall may be a similarly curved open mesh wire member 42 that permits exchange of heated air while protecting against accidental direct contact with strip 29. Alternatively the top of the heater may be flat with wire member 42 being a flat strip of perforated aluminum mesh.

Figure 2:
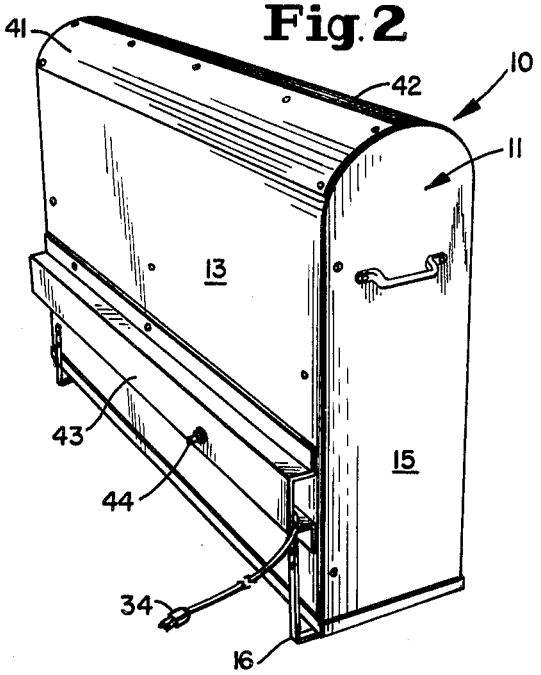
FIG. 2 is a generally perspective rear view of the heater of FIG. 1.

As shown in FIG. 2, the wires from the plug 34 may enter a protective tunnel 43 on the rear wall, with the switch 44 disposed within the tunnel.

Figure 6:
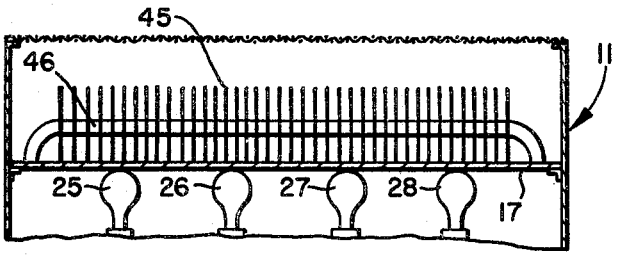
FIG. 6 is a fragmentary view showing another embodiment wherein fins conduct and radiate the heat from the heat collector plate.

FIG. 6 illustrates a further embodiment. The casing structure is the same as in FIGS. 1–4 including plate 17 and the contacting lamps. In FIG. 6 the convuluted strip 29 is replaced as a heat distribution device by a multiplicity of spaced thin metal fins 45 secured on a rigid metal rod in tube 46 that has its opposite ends fixedly mounted on the casing walls. The lower edges of the fins are in tight contact with the upper surface of heat collector plate 17 and may be soldered thereto for better heat conduction. Actually the fin and rod structures may be similar to that used in a conventional baseboard heater where the rod is hollow and carries heated fluid, except that here the rod serves only to support and locate the fins.

The lamps 25–28 are the sole sources of heat energy. The highly conductive copper plate 17 contacting the lamps serves as a heat collector and transfers the heat energy to the strip convulutions or fins, identified in the claims broadly as increased surface area heat radiation means, and heated air derived therefrom is applied to the room or other space to be heated.

In practice several of these 400 watt space heaters have been used to heat rooms in a dwelling in New Hampshire, and it has been found that they heated the rooms comfortably, often to 70°–73° F., under external temperature conditions that normally required operation of the oil-fired central heating system for the same comfort. The savings in heating costs are large, since the central heating system can be maintained inoperative during at least much of the day. The enclosure ensures that little or no disturbing stray light from the lamps will be experienced.

The units are inexpensive and require no servicing except lamps replacement. The lamps used are conventional gas-filled inside frost incandescent lamps that are primarily sold for lighting and can be purchased in any grocery or drug store. As compared with conventional electric heaters available today, the units of the invention consume considerably less power than the usual 1600 watt or more heaters on the market. Units of the invention in use have been found to cost about 1½ cents per hour for power.

Since the units are portable they may be moved from room to room or to cool spots in a space, to provide the sole heat needed for comfort or to aid the central heating system. For example, on a very cold day, even with sub-zero temperatures outside, a house could be heated initially up to temperature by the central heating system and then, during the balance of the day, the central heating system could be disabled and the interior heat level maintained by one or more units of the invention.

An openable door may be provided in either the front or rear walls of the casing for access to the lamps. These conventional lamps are usually designed for 750 hours life and may last longer.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a space heater unit, a casing having front, rear and end walls providing an enclosure, a substantially imperforate heat collector plate of high heat conductive material extending within the enclosure, said plate being disposed intermediate the top and bottom of the casing and extending substantially the length and width of the interior space defined by said casing so as to divide the casing interior into an upper heat distribution chamber and a lower closed heating chamber, a plurality of electric lamps mounted within said lower chamber, each of said lamps having glass bulbs in direct heat exchange contact with the underside of said plate, and increased surface area heat radiation means mounted in said upper chamber in direct heat conductive contact with and along the upper surface of said heat collection plate, the upper part of said casing having an opening extending over at least part of said top wall and through which heat from said heat conductor plate and radiation means passes into the space to be heated.

2. In the space heater defined in claim 1, said increased surface area heat radiation means being a convoluted strip of metal, the convolutions being spaced lengthwise of the strip and the valleys between convolutions being in direct rigid heat conductive contact with said plate.

3. In the space heater defined in claim 1, said increased surface area heat radiation means being a longitudinally spaced series of metal fins mounted on a common metal support and each having its lower edge in direct contact with the upper surface of said plate.

4. In the space heater defined in claim 1, means for selectively energizing all or a selected minor group of said lamps, for differential heat output.

5. In the space heater defined in claim 1, said lamps being conventional gas-filled inside frost incandescant lamps of the type normally used for lighting.

6. In the space heater defined in claim 1, means providing a protective mesh screen over said opening.

7. In the space heater defined in claim 1, said plate being a longitudinally flexible metal strip extending substantially entirely across the interior of the enclosure.

8. In the space heater defined in claim 1, said rear wall being contoured and arranged to reflect and direct heat outwardly through said opening.

* * * * *